US008484881B2

(12) United States Patent
Lindlau et al.

(10) Patent No.: US 8,484,881 B2
(45) Date of Patent: Jul. 16, 2013

(54) METHOD AND SYSTEM FOR MITIGATING PARALLAX IN GUN SIGHTS

(75) Inventors: Richard D. Lindlau, Waukesha, WI (US); Wayne B. Morgan, Lincoln, NE (US)

(73) Assignee: Range Tactics LLC, Genesee Depot, WI (US)

( * ) Notice: Subject to any disclaimer, the term of this patent is extended or adjusted under 35 U.S.C. 154(b) by 0 days.

(21) Appl. No.: 13/152,487

(22) Filed: Jun. 3, 2011

(65) Prior Publication Data

US 2012/0055063 A1 Mar. 8, 2012

Related U.S. Application Data

(60) Provisional application No. 61/380,374, filed on Sep. 7, 2010.

(51) Int. Cl.
*F41G 1/30* (2006.01)

(52) U.S. Cl.
USPC ..... 42/119; 42/130; 42/133

(58) Field of Classification Search
USPC ..... 42/119, 122, 129, 130, 136, 113, 42/131, 132, 133, 143
See application file for complete search history.

(56) References Cited

U.S. PATENT DOCUMENTS

| | | | | |
|---|---|---|---|---|
| 2,167,012 | A * | 7/1939 | Tetzlaff | 42/130 |
| 4,102,053 | A * | 7/1978 | Colwell | 42/136 |
| 6,289,625 | B1 * | 9/2001 | Phares | 42/119 |
| 2004/0025397 | A1 * | 2/2004 | Malley | 42/122 |

* cited by examiner

*Primary Examiner* — Stephen M Johnson
*Assistant Examiner* — John D Cooper
(74) *Attorney, Agent, or Firm* — Suiter Swantz pc llo

(57) ABSTRACT

A device for mitigating parallax in a reflex sight. The reflex sight having a front portion for receiving light and a rear portion for providing a visual of a target to a user. The parallax mitigation device defines a reticle positioned in an optical path of the reflex sight. The reticle is configured to indicate a center of the visual provided to the user.

11 Claims, 15 Drawing Sheets

METHOD AND SYSTEM FOR MITIGATING PARALLAX IN GUN SIGHTS

CROSS-REFERENCE TO RELATED APPLICATIONS

The present application claims the benefit under 35 U.S.C. §119(e) of U.S. Provisional Application Ser. No. 61/380,374, filed Sep. 7, 2010. Said U.S. Provisional Application Ser. No. 61/380,374 is hereby incorporated by reference in its entirety.

TECHNICAL FIELD

The disclosure generally relates to the field of gun sights, particularly to a method and system for mitigating parallax in gun sights.

BACKGROUND

Reflex sights are optical or computing sights that reflect a reticle image (or images) onto a combining glass for superimposition on the target. The M68 sight is a reflex sight. It uses a red aiming reference (collimated dot) and is designed for the "two eyes open" method of sighting. The dot follows the horizontal and vertical movement of the gunner's eye while remaining fixed on the target. The sight is parallax free beyond 50 meters and thus the shooter can place the dot of a properly zeroed weapon on a target regardless of its positioning the sight tube and hit the target at distances of 50 meters and greater. However, when zeroing the weapon or engaging targets at distances of 50 meters or closer the dot must be precisely centered to ensure accurate zeroing of weapon or accurate fire on targets. Failure to precisely center the red dot in the tube while zeroing the weapon will either cause difficulty in achieving a zero or if the red dot is maintained in the same non-centered position the soldier will have a false zero on his or her weapon and will be unsuccessful when engaging targets be they on a range or on the battlefield.

Parallax is an apparent displacement or difference in the apparent position of an object viewed along two different lines of sight, and is measured by the angle or semi-angle of inclination between those two lines. In the M68 series scopes this is caused by the fact that there are multiple lenses in the scope. Because of this the soldier may be required to make a visual estimation of center when zeroing this scope. This estimation may be difficult to accurately repeat and may be the most common and serious problem encountered by soldiers when zeroing.

SUMMARY

The present disclosure is directed to a parallax mitigation device is configured for mitigating parallax in a reflex sight. The reflex sight having a front portion for receiving light and a rear portion for providing a visual of a target to a user. The parallax mitigation device may include a cylindrical housing for engaging with the front portion or the rear portion of the reflex sight. The parallax mitigation device may further include a plurality of equal length bars each having one end secured to the cylindrical housing; the other end of each of the plurality of equal length bars extends from the cylindrical housing towards the center and terminates at a point leaving a gap of approximately a few millimeters apart from each other. A connecting member is utilized to connect the bars around the center position, and the connecting member also defines a hole at the center position, wherein the hole defined by the connecting member indicates a center of the visual provided to the user.

A further embodiment of the present disclosure is directed to a device for mitigating parallax in a reflex sight. The reflex sight having a front portion for receiving light and a rear portion for providing a visual of a target to a user. The device may include a transparent support surface positioned in an optical path of the reflex sight; and a pair of crosshairs located on the transparent support surface, the pair of crosshairs being configured to indicate a center of the visual provided to the user.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
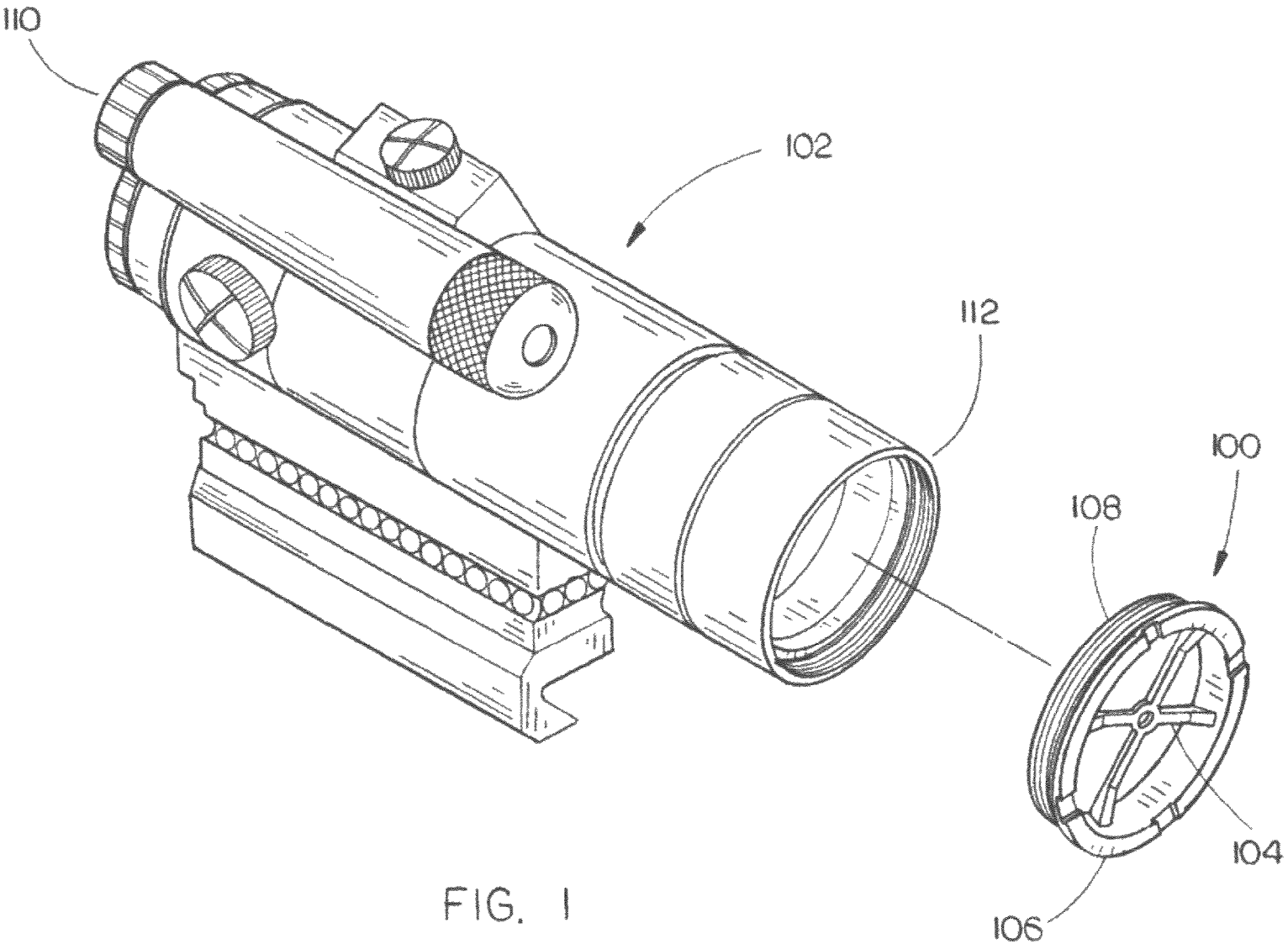
FIG. 1 is a perspective view of a parallax mitigation device and a red dot type scope.

Reference will now be made in detail to the subject matter disclosed, which is illustrated in the accompanying drawings.

Parallax in gun sights may cause a shooter difficulty in achieving a good zero. This in effect causes an enormous amount of wasted training time and excessive expenditure of ammunition. The lack of a good zero also reduces the soldier's confidence in their weapon and their ability to use it effectively. This in turn can compromise the safety of the individual soldier as well as the safety of their fellow soldiers. Red dot reflex sights, such as the M68, may be effectively parallax-free outside of a certain distance (e.g., 50 meters), meaning that while the red dot moves around the inside of sight based on eye position, it always represents the point of aim. However, parallax may still occur if the target is at a distance of 50 meters or closer.

The method and system for parallax mitigation of the present disclosure may save up to one third of the time now spent by the soldier while zeroing and qualifying which frees this time up for other training. This also means saving up to one third the ammunition resulting in the possible saving of millions of dollars of ammunition. This reduction of ammunition also benefits the environment as less lead ends up being used and expended. Furthermore, another important benefit is an accurately zeroed weapon increasing soldier effectiveness and survivability on the battlefield.

The zeroing of the M68 begins in the same manner as any other zero, with a grouping exercise to ensure the shooter is utilizing the proper fundamentals of marksmanship. This simple procedure requires the shooter to precisely center the red dot of his or her weapon for each and every shot which can be quite challenging. If this centering of the dot is not accomplished the soldier will have a difficult time grouping their shots to standard. The standard is to fire two three shot groups and have all six shots fall within a four centimeter circle at a distance of 25 meters. 25 meters being the established grouping and zeroing distance prescribed for us military weapons.

Several kinds of problems may arise during the grouping exercise. First, the soldier may not be able to maintain precise placement of the red dot for three shots in a row. The result of this is one of the largest contributing factors towards the soldier's inability to meet established grouping standards. The second error would be that the soldier may be able to visually place the red dot in the same place in relation to the center of the sight tube, but not in the same spot for consecutive shot groups. This may result in acceptable three shot groups but the location of these shot groups are scattered on the target and again the standards are not met. Furthermore, a third error may occur occasionally. This is when the soldier is able to maintain the dot in the same position consistently for multiple shot groups. This soldier is unfortunate as they will be able to zero their weapon quickly. The reason that this is unfortunate is that the zero achieved is a false zero. It simply shows consistent inconsistency and when the soldier moves to a qualification range or the battlefield they will not be successful. While failure on the range can be corrected, it destroys the soldiers' confidence in their equipment. Failure on the battlefield is another thing entirely and can result in an easily preventable loss of life.

The errors previously described are common as many soldiers are only firing for qualification on an annual basis and the amount of ammunition in many instances is limited. No matter the reason, the result is an inordinate amount of time, ammunition and frustration spent on what should be a simple task. The solution is the parallax mitigation/elimination device of the present disclosure. While the intent of the parallax mitigation device of the present disclosure is to alleviate the problems experienced by individuals attempting to zero and qualify with the aim point designed and produced for the M68 series of scopes, it is understood that the M68 series of scopes are merely exemplary, and that the parallax mitigation device of the present disclosure is applicable to any red dot type scope of similar designs.

Referring generally to FIGS. 1 through 7, a parallax mitigation device 100 for a reflex type gun sight/scope 102 (e.g., a red dot sight such as the M68) is shown. The scope 102 includes a front portion 112 for receiving light and a rear portion 110 for providing a visual of a target to the shooter. The parallax mitigation device 100 provides a reticle 104 (e.g., crosshairs) to enable the shooter to get consistent, precise placement of the red dot in the exact center of the visual on every shot. In one embodiment, the reticle 104 is enclosed in a generally cylindrical housing 106. The generally cylindrical housing 106 may have a threaded portion 108 for mounting to the front portion 112 of the scope 102. It is contemplated that other fastening mechanisms such as snap fit mechanisms, friction fit mechanisms, or the like may be utilized for securing the parallax mitigation device 100 to the scope 102.

Figure 2:
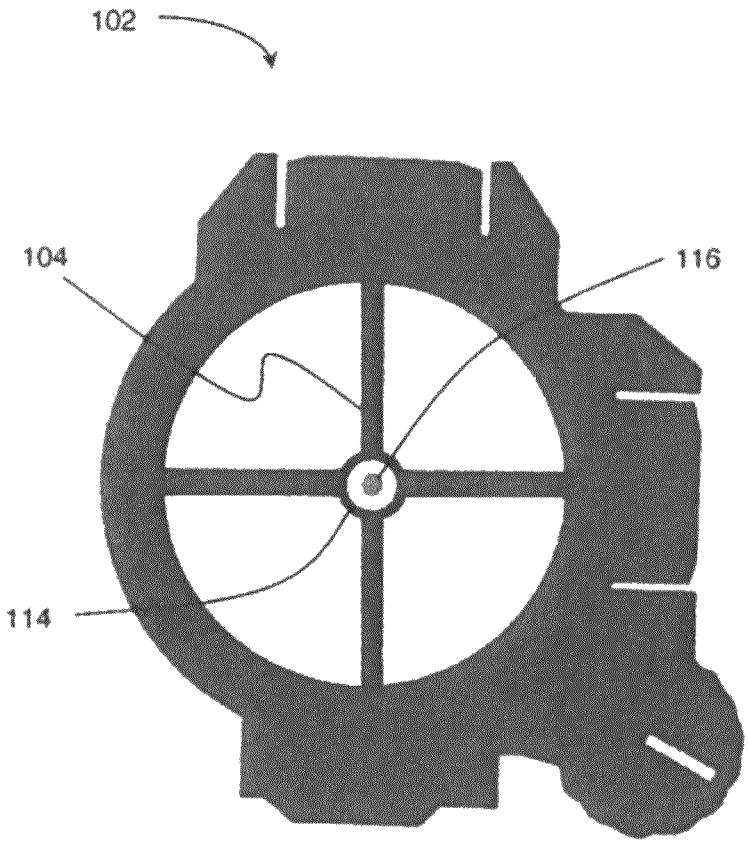
FIG. 2 is an illustration depicting the shooter's view through the red dot type scope with the parallax mitigation device installed
Figure 3:
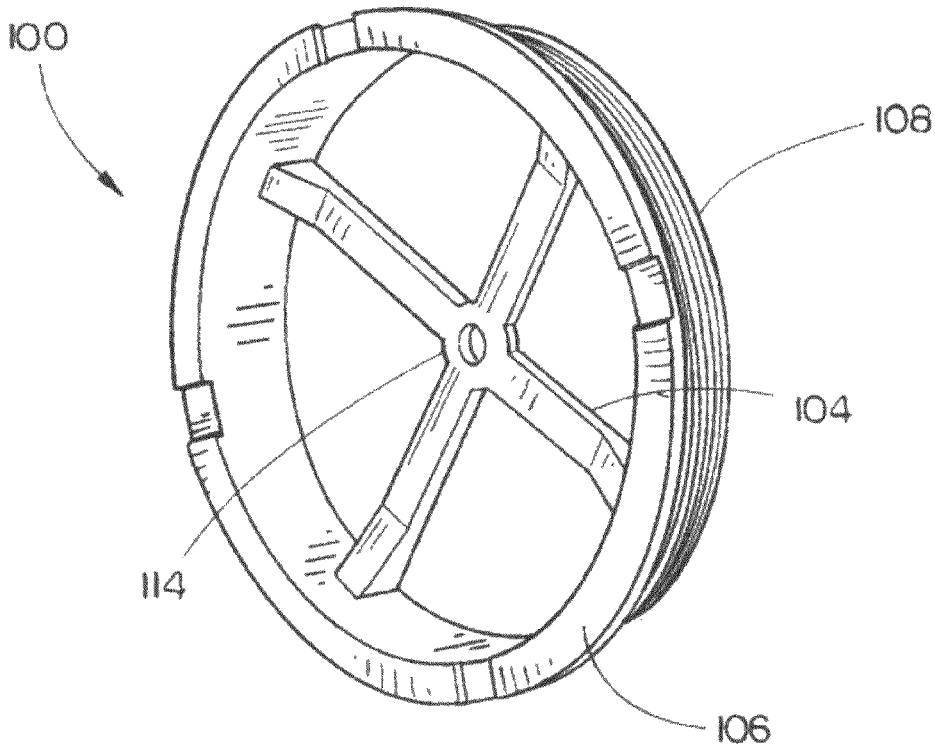
FIG. 3 is an isometric view of the parallax mitigation device illustrated in FIG. 1.
Figure 4:
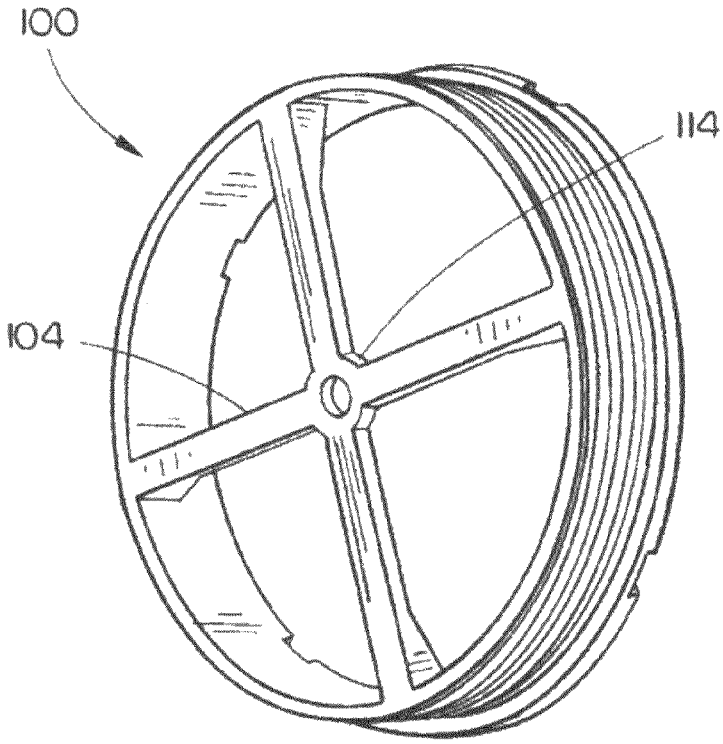
FIG. 4 is another isometric view of the parallax mitigation device illustrated in FIG. 1.
Figure 5:
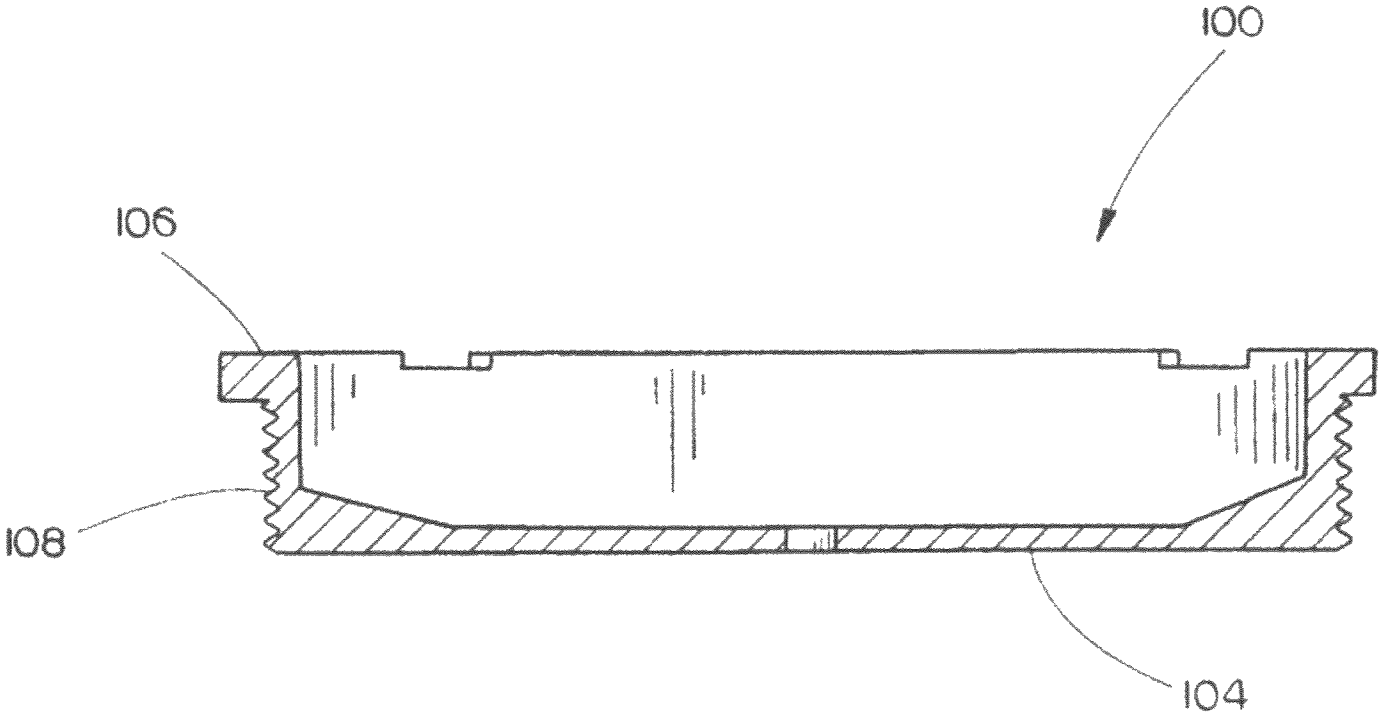
FIG. 5 is a cross-sectional view of the parallax mitigation device illustrated in FIG. 1.

FIG. 2 is an illustration depicting the shooter's view through the scope 102 with the parallax mitigation device 100 installed. In one embodiment, the reticle 104 are defined utilizing four equal length bars each having one end secured to the cylindrical housing of the parallax mitigation device 100 at the 12, 3, 6 and 9 o'clock positions (with respect to the orientation shown in FIG. 2). The other end of each of the four bars extends from the cylindrical housing towards the center and terminates at a point leaving a gap of approximately a few millimeters apart from each other. A connecting member 114 connects the bars around the center and defines a hole (circular or other shapes) at the center. The hole in turn indicates the center position at which the shooter should place the red dot 116 provided by the scope 102. In this manner, the parallax mitigation device 100 of the present disclosure may eliminate the error caused by the parallax of the sight and give the shooter an accurate and consistent zero every time. In one embodiment, the radius of the hole defined by the connecting member 114 may be approximately one to two millimeters.

Figure 6:
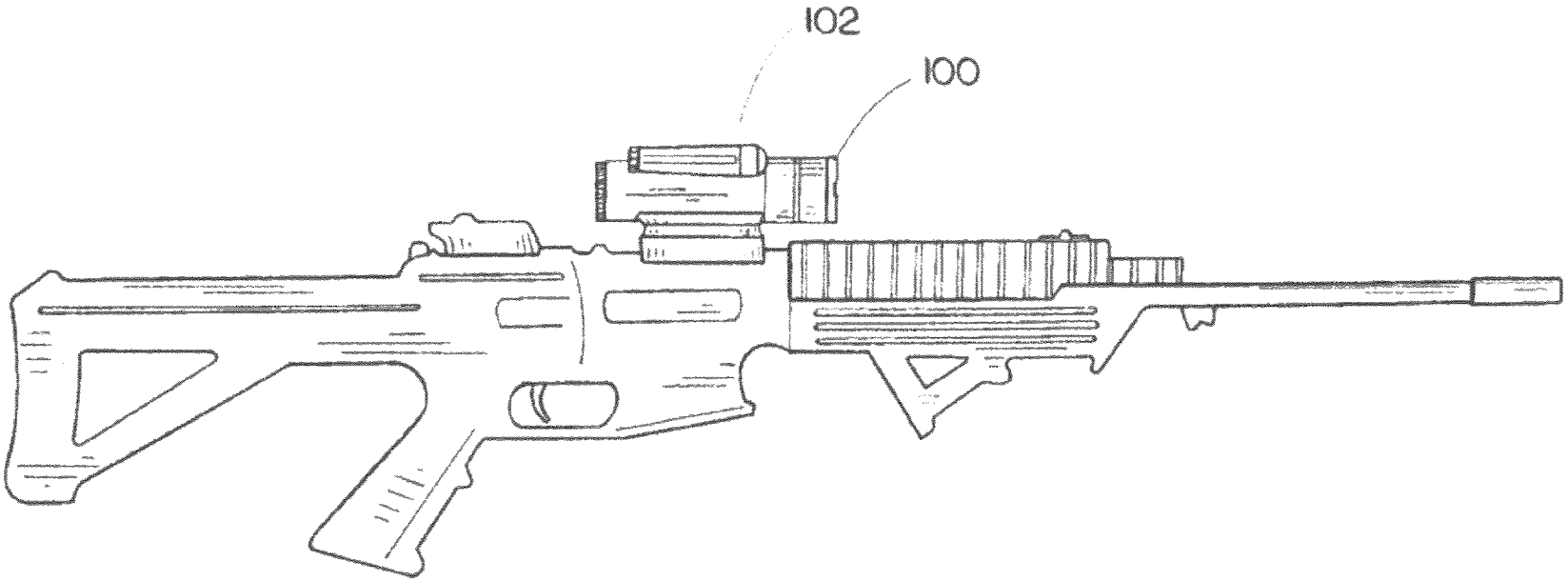
FIG. 6 is a side view of the parallax mitigation device and the red dot type scope, wherein the parallax mitigation device is mounted to the front portion of the red dot type scope.
Figure 7:
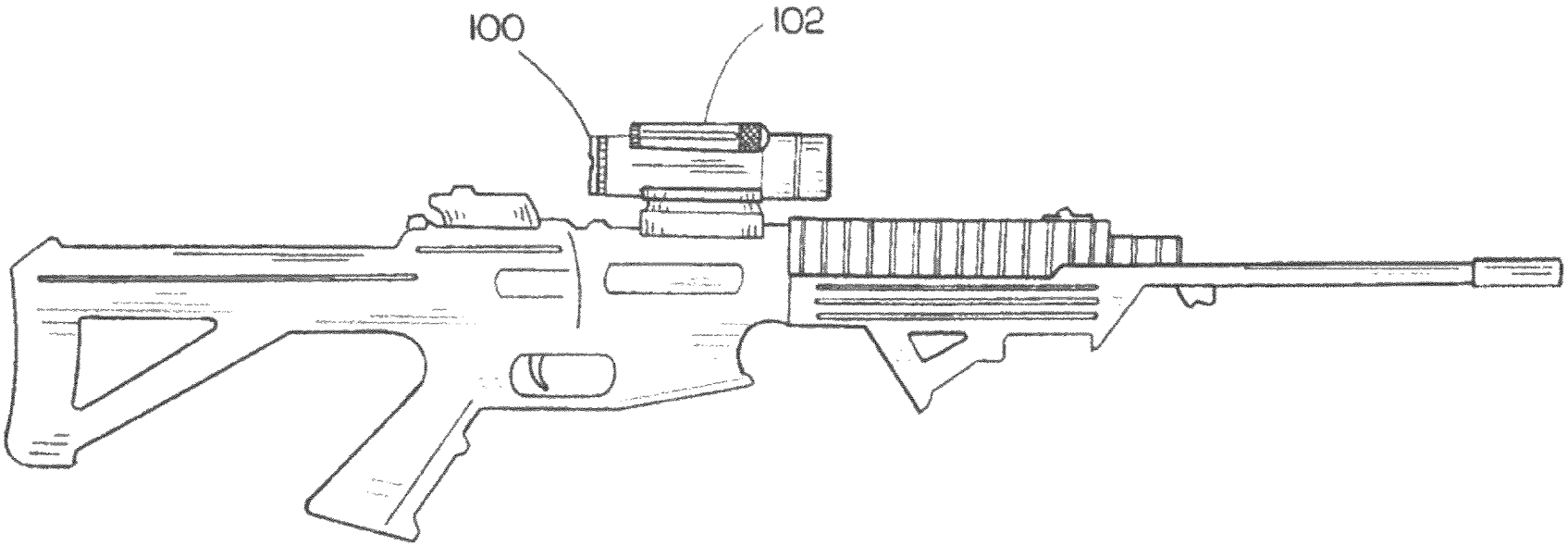
FIG. 7 is another side view of the parallax mitigation device and the red dot type scope, wherein the parallax mitigation device is mounted to the rear portion of the red dot type scope.

It is contemplated that the parallax mitigation device 100 may be positioned at the front of the scope 102 in various ways. The type of attachment could be of a slip on, flip up or any number of other methods to include those of an internal or illuminated design. For example, as illustrated in FIGS. 1 and 6, the front portion of the scope 102 may include a slot to accommodate an insertion of the parallax mitigation device 100. The design of the crosshairs could be of different configurations or colors as well as long as the purpose is to assist the shooter in exact centering of the red dot within the tube of the scope 102. It is also contemplated that the parallax mitigation device 100 may be positioned at the rear of the scope 102 to achieve the same results, as illustrated in FIG. 7. In general, the parallax mitigation device 100 may be placed in the optical path of the reflex scope (e.g., front, rear or within the scope) as long as it provides a reference to the shooter and thus helps the shooter to place the red dot in the center.

Figure 8:
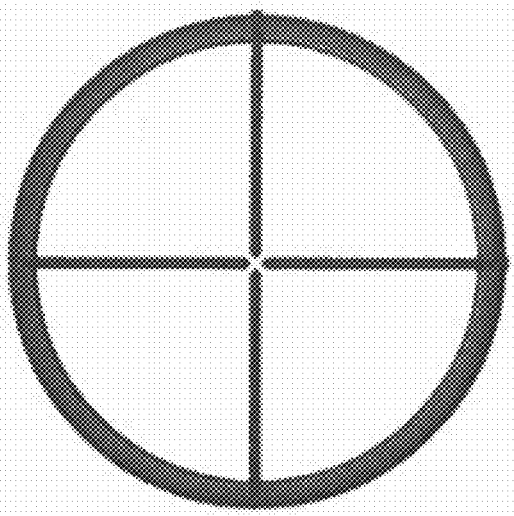
FIG. 8 is a top view of a parallax mitigation device having a standard crosshairs/reticle configuration.
Figure 9:
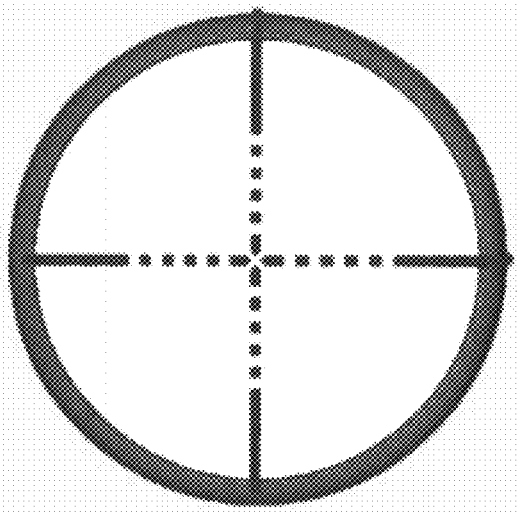
FIG. 9 is a top view of a parallax mitigation device having an offset crosshairs/reticle configuration.

It is also contemplated that the parallax mitigation device 100 may indicate the center position in a variety of ways. For instance, instead of utilizing the connecting member 114 supported by the bars to indicate the center position, other types of support members may be utilized without departing from the spirit and scope of the present disclosure. For example, a transparent/translucent support surface (e.g., glass) may be enclosed in the cylindrical housing 106. The support surface may have embedded and/or marked position indicators as shown in FIG. 8. Furthermore, an offset crosshairs/reticle as shown in FIG. 9 may also be utilized. Such crosshairs may be utilized to get consistent dot placement for off center testing/shooting purposes. Offset crosshairs may also be utilized to demonstrate the effects of incorrect placement as well as to validate the effectiveness of the parallax mitigation device 100. However, the reticle 104 as depicted in FIGS. 1 through 5 may be appreciated as this particular implementation does not introduce reflections and/or glares. Furthermore, the parallax mitigation device 100 utilizing the reticle 104 as depicted in FIGS. 1 through 5 may be modeled as a single-piece device, which may be easier to manufacture and maintain.

Figure 10:
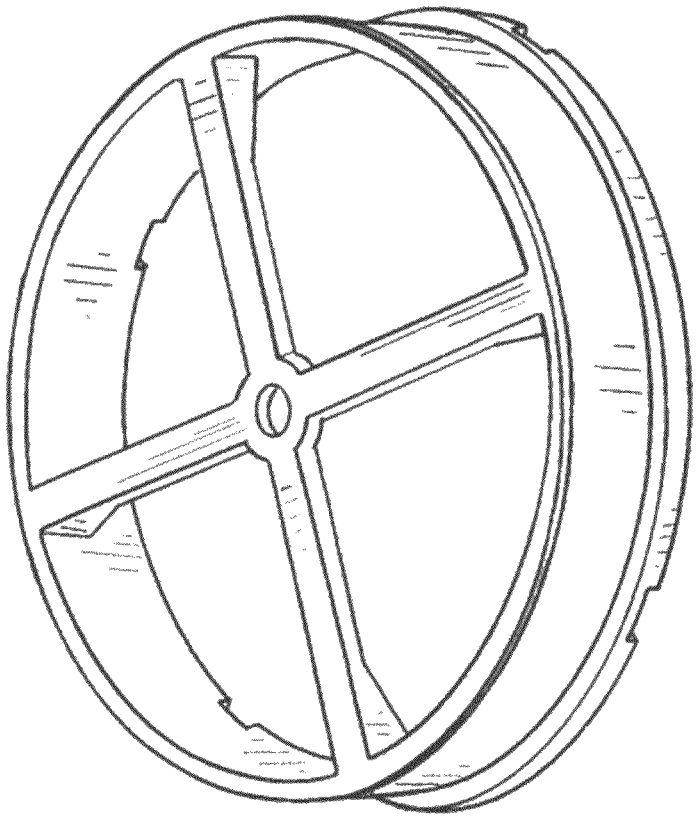
FIG. 10 is an isometric view of a parallax mitigation device utilizing friction fit mechanisms.

While the example above describes a threaded portion 108 for mounting the parallax mitigation device 100 to the scope 102, it is contemplated that other fastening mechanisms may be utilized for securing the parallax mitigation device 100 to the scope 102. For instance, the parallax mitigation device 100 as shown in FIG. 10 may utilize friction fit mechanisms to engage with the scope 102. Other mechanisms such as snap fit mechanisms or the like may be utilized without departing from the spirit and scope of the present disclosure.

Figure 11:
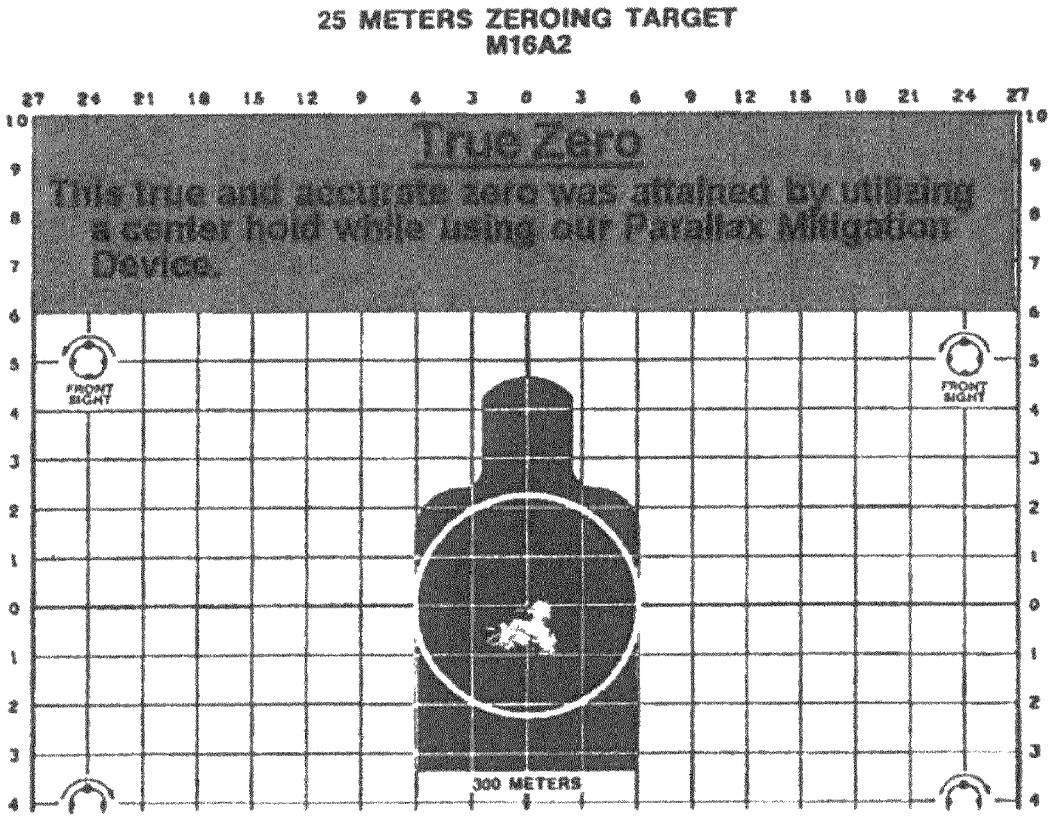
FIG. 11 is an illustration depicting a set of test results having true and accurate zero.
Figure 12:
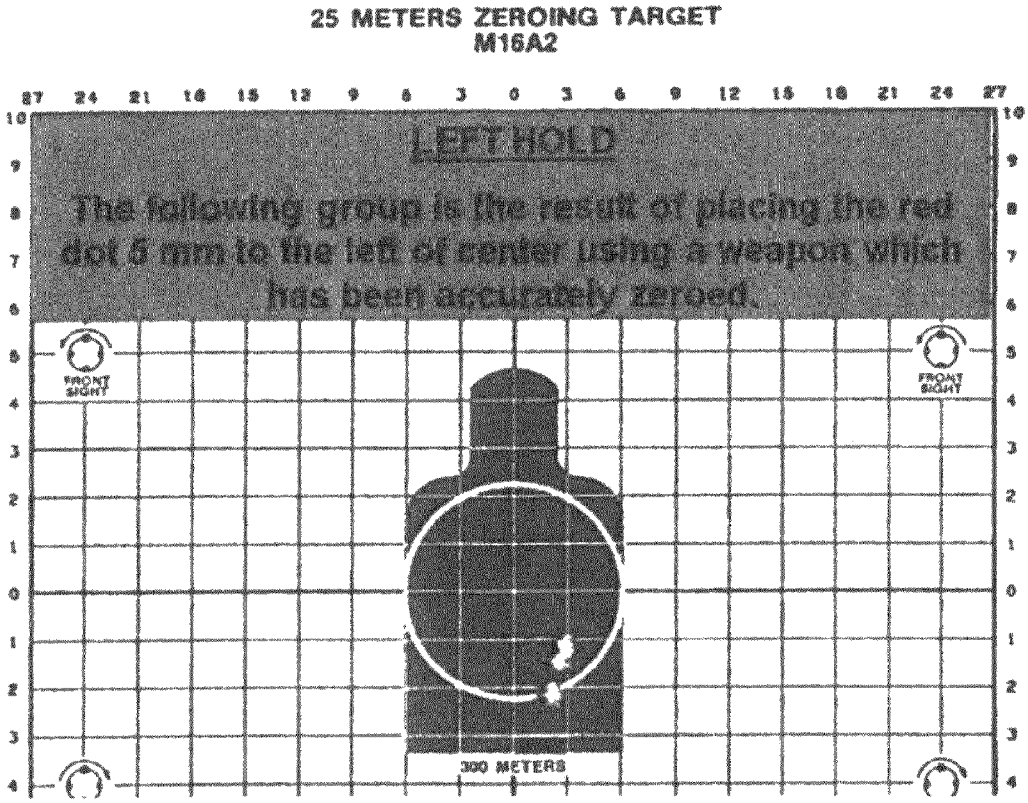
FIG. 12 is an illustration depicting a set of left hold test results.
Figure 13:
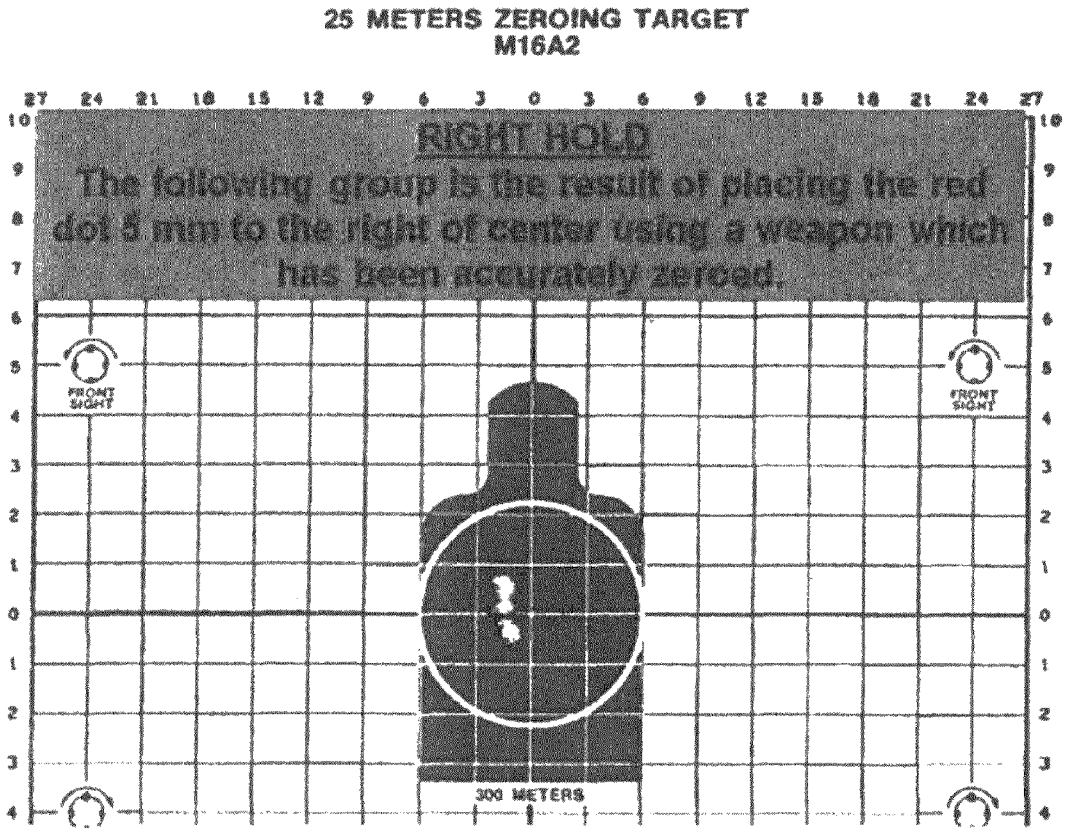
FIG. 13 is an illustration depicting a set of right hold test results.
Figure 14:
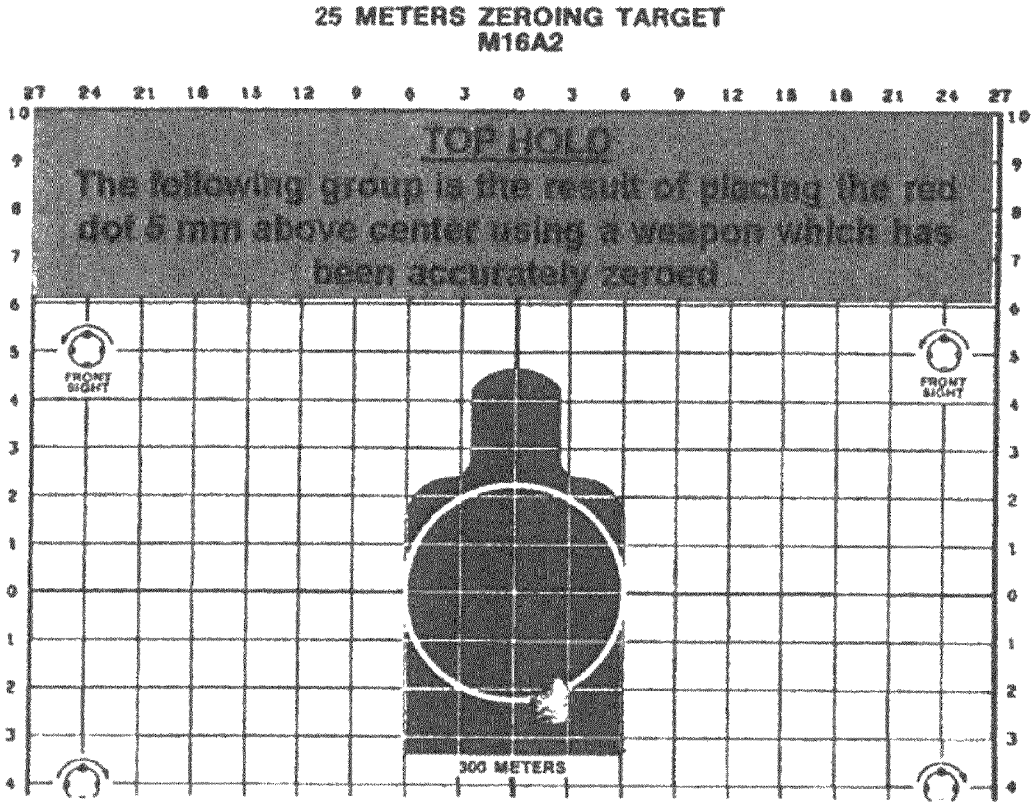
FIG. 14 is an illustration depicting a set of top hold test results.
Figure 15:
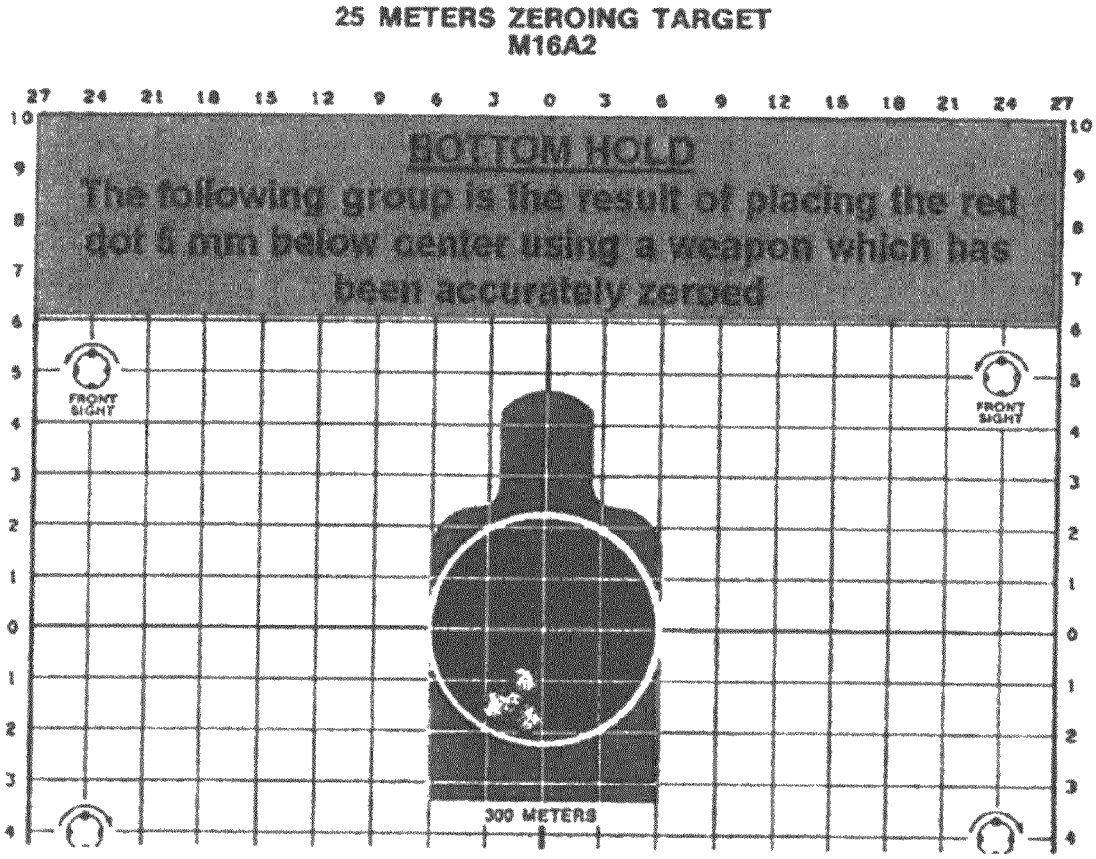
FIG. 15 is an illustration depicting a set of bottom hold test results.

Referring generally to FIGS. 11 through 17, a series of test results are illustrated. FIG. 11 illustrates a set of test results having true and accurate zero. This set was attained by utilizing a center hold while using the parallax mitigation device 100. FIG. 12 illustrates a set of left hold test results. This set was attained as a result of placing the red dot 5 mm to the left of center using a weapon which has been accurately zeroed. FIG. 13 illustrates a set of right hold test results. This set was attained as a result of placing the red dot 5 mm to the right of center using a weapon which has been accurately zeroed. FIG. 14 illustrates a set of top hold test results. This set was attained as a result of placing the red dot 5 mm above center using a weapon which has been accurately zeroed. FIG. 15 illustrates a set of bottom hold test results. This set was attained as a result of placing the red dot 5 mm below center using a weapon which has been accurately zeroed.

Figure 16:
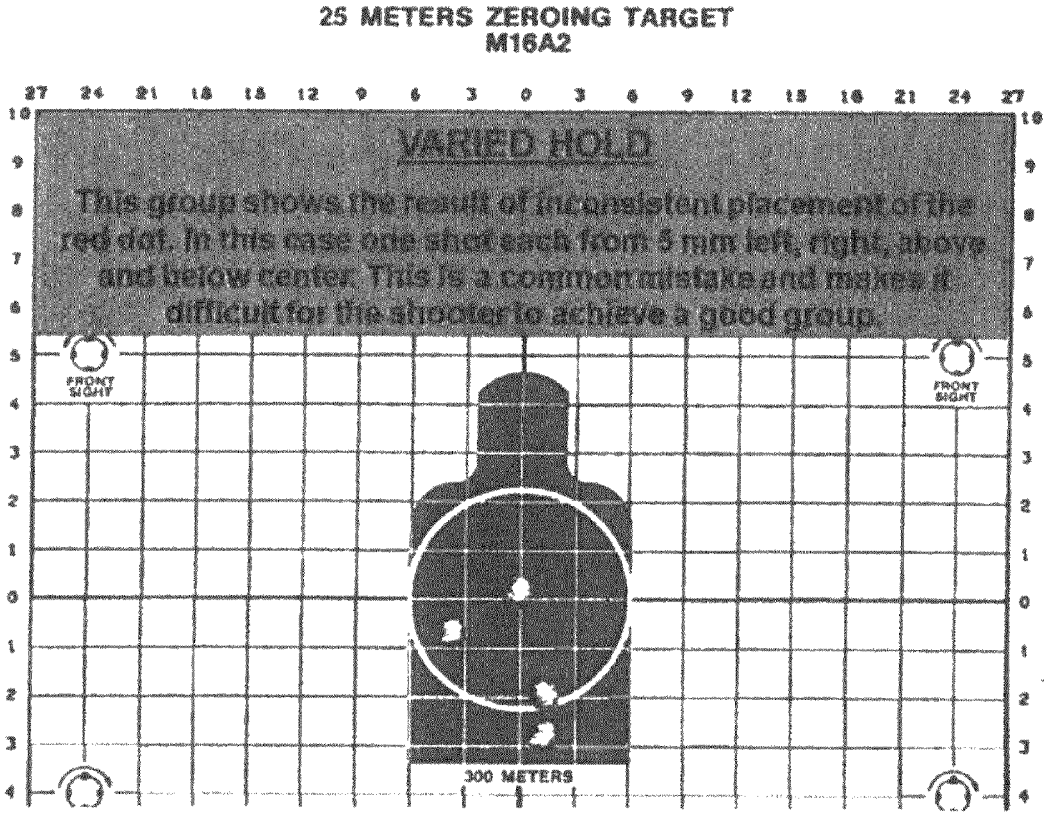
FIG. 16 is an illustration depicting a set of varied hold test results.
Figure 17:
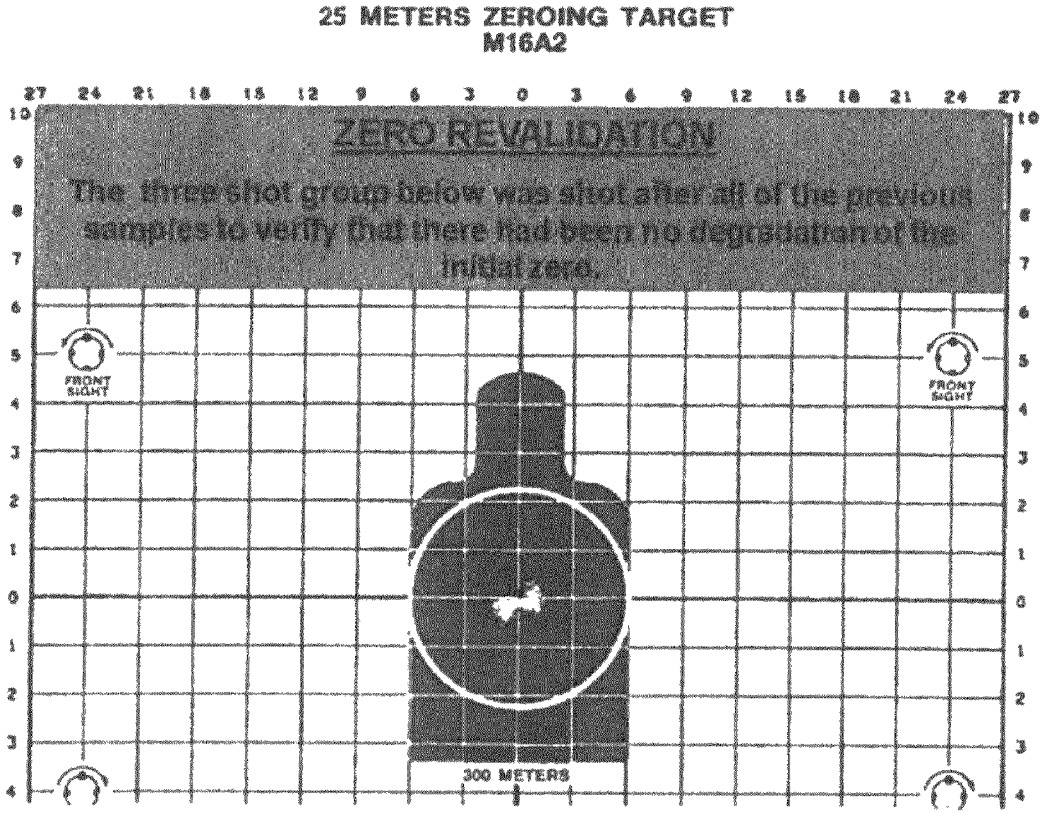
FIG. 17 is an illustration depicting a set of test results having true and accurate zero upon completion of the accuracy test.

Furthermore, FIG. 16 illustrates a set of varied hold test results. This set shows the result of inconsistent placement of the red dot. In this case one shot each from 5 mm left, right, above and below center. This is a common mistake and makes it difficult for the shooter to achieve a good group. To complete the verification of the accuracy, three shot groups was shot after all of the previous samples (FIGS. 11 through 16) to verify that there had been no degradation of the initial zero. The result of this last set is shown in FIG. 17.

It is believed that the system and method of the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory.

What is claimed is:

1. An apparatus, comprising:

a reflex sight, the reflex sight having a front portion for receiving light and a rear portion for providing a visual of a target and a projection of an aiming point superimposed on the visual to a user; and a parallax mitigating device coupled to the reflex sight, the parallax mitigating device configured for indicating a center position for mitigating parallax in the reflex sight, the parallax mitigating device including:

a cylindrical housing, the cylindrical housing having a threaded portion for securing to at least one of: the front portion of the reflex sight or the rear portion of the reflex sight;

a plurality of equal length bars, each of the plurality of equal length bars having a first end and a second end, the first end of each of the plurality of equal length bars is secured to the cylindrical housing and the second end of each of the plurality of equal length bars extends towards the center position; and a connecting member, the connecting member configured for connecting the second ends of the plurality of equal length bars around the center position, the connecting member further configured for defining a hole at the center position;

wherein the hole defined by the connecting member indicates a center of the visual provided to the user, and parallax in the reflex sight is mitigated by placing the superimposed aiming point at the center of the visual.

2. The apparatus of claim 1, wherein the reflex sight is a red dot type scope.

3. The apparatus of claim 1, wherein the threaded portion is configured for securing to the front portion of the reflex sight.

4. The apparatus of claim 1, wherein the threaded portion is configured for securing to the rear portion of the reflex sight.

5. The apparatus of claim 1, wherein the hole defined by the connecting member is circular in shape, and has a radius of approximately one to two millimeters.

6. An apparatus, comprising:

a reflex sight, the reflex sight having a front portion for receiving light and a rear portion for providing a visual of a target and a projection of an aiming point superimposed on the visual to a user; and a parallax mitigating device coupled to the reflex sight, the parallax mitigating device configured for indicating a center position for mitigating parallax in the reflex sight, the parallax mitigating device including:

a cylindrical housing, the cylindrical housing configured for engaging with at least one of: the front portion of the reflex sight or the rear portion of the reflex sight;

a plurality of equal length bars, each of the plurality of equal length bars having a first end and a second end, the first end of each of the plurality of equal length bars is secured to the cylindrical housing and the second end of each of the plurality of equal length bars extends towards the center position; and a connecting member, the connecting member configured for connecting the second ends of the plurality of equal length bars around the center position, the connecting member further configured for defining a hole at the center position;

wherein the hole defined by the connecting member indicates a center of the visual provided to the user, and parallax in the reflex sight is mitigated by placing the superimposed aiming point at the center of the visual.

7. The apparatus of claim 6, wherein the reflex sight is a red dot type scope.

8. The apparatus of claim 6, wherein the hole defined by the connecting member is circular in shape, and has a radius of approximately one to two millimeters.

9. The apparatus of claim 6, wherein the cylindrical housing is configured for engaging with the front portion of the reflex sight.

10. The apparatus of claim 6, wherein the cylindrical housing is configured for engaging with the rear portion of the reflex sight.

11. The apparatus of claim 6, wherein the cylindrical housing is configured for engaging with the reflex sight utilizing at least one of: a threaded fastening mechanism, a snap fit mechanism or a friction fit mechanism.

* * * * *